US009175473B2

(12) United States Patent
Kaump

(10) Patent No.: US 9,175,473 B2
(45) Date of Patent: Nov. 3, 2015

(54) CEILING TILE SYSTEM

(71) Applicant: Modular Arts, Inc., Seattle, WA (US)

(72) Inventor: Donald L. Kaump, Seattle, WA (US)

(73) Assignee: Modular Arts, Inc., Seattle, WA (US)

( * ) Notice: Subject to any disclaimer, the term of this patent is extended or adjusted under 35 U.S.C. 154(b) by 0 days.

(21) Appl. No.: 14/463,523

(22) Filed: Aug. 19, 2014

(65) Prior Publication Data

US 2015/0047293 A1 Feb. 19, 2015

Related U.S. Application Data

(60) Provisional application No. 61/867,389, filed on Aug. 19, 2013.

(51) Int. Cl.

| | |
|---|---|
| ***E04B 2/00*** | (2006.01) |
| ***E04B 9/04*** | (2006.01) |
| ***E04B 9/12*** | (2006.01) |

(52) U.S. Cl.

CPC ..... *E04B 9/0428* (2013.01); *E04B 9/0464* (2013.01); *E04B 9/127* (2013.01)

(58) Field of Classification Search

CPC ..... E04B 9/18; E04B 9/34; E04B 9/00; E04B 9/345; E04B 2002/7468; Y10S 52/04; Y10S 403/01; E04F 13/0871; E04F 13/0883; E04F 15/02144; B44F 7/00

See application file for complete search history.

(56) References Cited

U.S. PATENT DOCUMENTS

| | | | | | |
|---|---|---|---|---|---|
| 2,009,512 | A | * | 7/1935 | Offutt et al. | 52/145 |
| 2,410,413 | A | * | 11/1946 | Hurley | 181/30 |
| 3,229,439 | A | | 1/1966 | Strobel | |
| 3,617,336 | A | | 11/1971 | Gilard et al. | |
| 4,062,162 | A | * | 12/1977 | Nicklaus et al. | 52/506.1 |
| 4,083,153 | A | * | 4/1978 | Sumpter | 52/28 |
| 4,245,442 | A | * | 1/1981 | Durham | 52/126.4 |
| 4,367,615 | A | | 1/1983 | Feldman | |
| 4,393,631 | A | * | 7/1983 | Krent | 52/144 |
| 4,471,596 | A | * | 9/1984 | Deaton et al. | 52/668 |
| 4,681,481 | A | | 7/1987 | Kapusta | |
| 4,698,949 | A | | 10/1987 | Dietrich | |
| 4,747,246 | A | * | 5/1988 | Sanborn | 52/506.07 |
| 4,873,809 | A | * | 10/1989 | Paul | 52/506.07 |
| 5,414,969 | A | * | 5/1995 | Krejci et al. | 52/311.3 |
| 5,466,089 | A | | 11/1995 | Jurik | |
| 5,813,186 | A | | 9/1998 | Acksel | |
| 5,836,127 | A | * | 11/1998 | Clark et al. | 52/506.07 |
| 5,911,660 | A | | 6/1999 | Watson | |
| 6,062,772 | A | | 5/2000 | Perkins | |
| 6,176,059 | B1 | | 1/2001 | Cantarano et al. | |
| 6,253,519 | B1 | | 7/2001 | Daniel | |
| D464,737 | S | * | 10/2002 | Gulbrandsen et al. | D25/58 |
| 6,595,482 | B1 | * | 7/2003 | Armbruster | 248/544 |
| 6,907,705 | B2 | | 6/2005 | Dean et al. | |

(Continued)

*Primary Examiner* — Brian Glessner

*Assistant Examiner* — Gisele Ford

(74) *Attorney, Agent, or Firm* — Seed IP Law Group PLLC

(57) ABSTRACT

A ceiling structure includes a suspended framework having a plurality of main runners and a plurality of cross runners interconnected to define an array of tile receiving openings and a plurality of ceiling tiles positioned within the array of tile receiving openings, each of the plurality of ceiling tiles having a plurality of magnets positioned at a peripheral portion thereof which are configured to magnetically couple the ceiling tile within a respective one of the tile receiving openings with the ceiling tile abutting a respective mounting frame. Related methods are also provided.

19 Claims, 6 Drawing Sheets

(56) References Cited

U.S. PATENT DOCUMENTS

| | | | | |
|---|---|---|---|---|
| 7,107,731 | B2 | 9/2006 | Record | |
| 7,207,146 | B1 | 4/2007 | Morrell | |
| D546,478 | S | 7/2007 | Adam | |
| 7,367,167 | B2 | 5/2008 | Takayanagi | |
| 7,410,328 | B2 | 8/2008 | Hamel | |
| 7,637,688 | B2 | 12/2009 | Riccobene | |
| 7,661,228 | B1 | 2/2010 | Nolte et al. | |
| 7,694,485 | B1 | 4/2010 | Siener | |
| 8,002,494 | B2 | 8/2011 | Ciccarello | |
| 8,074,419 | B1 | 12/2011 | Humphress et al. | |
| D662,616 | S * | 6/2012 | Waters et al. | D25/157 |
| 8,375,665 | B2 | 2/2013 | Kaump | |
| D686,348 | S * | 7/2013 | Martin et al. | D25/138 |
| D697,641 | S * | 1/2014 | Ghoujaei Yousefi | D25/138 |
| 2002/0078653 | A1 | 6/2002 | Jean | |
| 2003/0121227 | A1 * | 7/2003 | Wendt | 52/506.07 |
| 2003/0205016 | A1 * | 11/2003 | Gulbrandsen et al. | 52/506.06 |
| 2006/0101764 | A1 * | 5/2006 | Jankovec et al. | 52/506.07 |
| 2010/0101164 | A1 | 4/2010 | Broden | |
| 2010/0162642 | A1 | 7/2010 | Allard et al. | |
| 2010/0162648 | A1 | 7/2010 | Thomassen | |
| 2010/0242377 | A1 | 9/2010 | Koteskey | |
| 2011/0067333 | A1 | 3/2011 | Lacas et al. | |
| 2011/0072753 | A1 | 3/2011 | MacDonald | |
| 2011/0078970 | A1 * | 4/2011 | Boyd | 52/506.07 |
| 2011/0203197 | A1 | 8/2011 | Najafi et al. | |
| 2011/0252728 | A1 | 10/2011 | Scherrer | |
| 2012/0042599 | A1 | 2/2012 | Thiagarajan et al. | |
| 2012/0167513 | A1 * | 7/2012 | Ahren | 52/506.07 |
| 2013/0067833 | A1 * | 3/2013 | Aguera Riquelme | 52/127.8 |

* cited by examiner

CEILING TILE SYSTEM

BACKGROUND

1. Technical Field

The present disclosure relates to ceiling structures, and more particularly, to ceiling tiles for constructing a ceiling structure, and systems and methods for assembling the same.

2. Description of the Related Art

Conventional suspended ceiling structures are constructed by assembling a ceiling structure grid above a floor and at the upper end of walls that form a boundary around residential or commercial space. The ceiling structure grid primarily includes a plurality of main runners and cross runners, which may be suspended by wires or the like from the overhead structure above. The pluralities of main runners and cross runners are generally oriented to be perpendicular to each other. The plurality of main runners and cross runners are each spatially spaced apart and interconnect at positions of intersection, which defines an opening to receive ceiling tiles. Conventional ceiling tiles are positioned within such openings from above and rest on the grid in a non-secured manner. Construction and assembly of such conventional suspended ceiling structures can be complicated, time consuming, laborious, and may not result in an aesthetically pleasing ceiling.

BRIEF SUMMARY

Embodiments described herein provide simple and efficient systems and methods for constructing and assembling ceiling structures, including assembling ceiling tiles in a secure and robust manner.

According to one embodiment, a ceiling structure may be summarized as including a suspended framework and a plurality of ceiling tiles. The suspended framework may include a plurality of main runners and a plurality of cross runners. The plurality of main runners may be interconnected to define an array of tile receiving openings, each of the plurality of main runners and the plurality of cross runners including a tile mating surface facing downward to define a mounting frame at each respective tile receiving opening. The plurality of ceiling tiles may be positioned within the array of tile receiving openings, each of the plurality of ceiling tiles having a plurality of magnets positioned at a peripheral portion thereof which are configured to magnetically couple the ceiling tile within a respective one of the tile receiving openings with the ceiling tile abutting the respective mounting frame.

According to another embodiment, a system of ceiling tiles attachable to a suspended framework, with the suspended framework having a plurality of main runners and a plurality of cross runners interconnected to define an array of tile receiving positions, may be summarized as including a plurality of modular tiles configured to form a generally continuous ceiling structure when arranged at the array of tile receiving positions. Each modular tile may include a main body including a peripheral portion and an external side having an arrangement of three-dimensional surfaces; and a plurality of magnets positioned within the peripheral portion of the main body to produce a magnetic force to couple the modular tile to the suspended framework.

According to another embodiment, a system of ceiling tiles attachable to a suspended framework, with the suspended framework having a plurality of main runners and a plurality of cross runners interconnected to define an array of tile receiving positions may be summarized as including a plurality of ceiling tiles configured to form a generally continuous ceiling structure when arranged at the array of tile receiving positions. Each ceiling tile may include a main body including an external side having an arrangement of three-dimensional surfaces, a peripheral portion, and side surfaces forming a perimeter around the ceiling tile, each side surface including an exterior edge comprising a complex curve or shape that substantially aligns with a respective complex curve or shape of a corresponding exterior edge of a corresponding side surface of an adjacent ceiling tile such that a three-dimensional contour is maintained across an interface of adjacent ceiling tiles; and a plurality of radial magnets positioned within the peripheral portion of the ceiling tile, the radial magnets being oriented to produce a magnetic force in a direction substantially normal to the suspended framework.

According to another embodiment, a ceiling structure may be summarized as including a suspended framework, a plurality of ceiling tiles, and a pair of opposing first gaskets and a pair of opposing second gaskets secured to the ceiling tiles. The suspended framework may include a plurality of main runners and a plurality of cross runners. The plurality of main runners may be interconnected to define an array of tile receiving openings, each of the plurality of main runners and the plurality of cross runners including a tile mating surface facing downward to define a mounting frame at each respective tile receiving opening. The plurality of ceiling tiles may be positioned within the array of tile receiving openings, each of the plurality of ceiling tiles having a plurality of magnets positioned at a peripheral portion thereof which are configured to magnetically couple the ceiling tile within a respective one of the tile receiving openings with the ceiling tile abutting the respective mounting frame. The first and second gaskets may be secured to the ceiling tiles so as to fill a gap between adjacent ceiling tiles, such that an exterior contour of the ceiling structure appears substantially continuous.

According to another embodiment, a ceiling structure may be summarized as including a suspended framework, a plurality of ceiling tiles, and a first gasket and a second gasket secured to a respective first surface and a respective second surface of the ceiling tiles, the first and second surfaces being substantially perpendicular to one another. The suspended framework may include a plurality of main runners and a plurality of cross runners. The plurality of main runners may be interconnected to define an array of tile receiving openings, each of the plurality of main runners and the plurality of cross runners including a tile mating surface facing downward to define a mounting frame at each respective tile receiving opening. The plurality of ceiling tiles may be positioned within the array of tile receiving openings, each of the plurality of ceiling tiles having a plurality of magnets positioned at a peripheral portion thereof which are configured to magnetically couple the ceiling tile within a respective one of the tile receiving openings with the ceiling tile abutting the respective mounting frame. The first and second gaskets may be secured to the ceiling tiles so as to fill a gap between adjacent ceiling tiles, such that an exterior contour of the ceiling structure appears substantially continuous.

According to another embodiment, a method for assembling a ceiling structure may be summarized as including constructing a suspended framework having a plurality of main runners and a plurality of cross runners interconnected to define an array of tile receiving positions; and magnetically coupling a plurality of ceiling tiles to the suspended framework with a respective ceiling tile located at each tile receiving position.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and methods associated with suspended ceiling tile systems and ceiling tiles may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
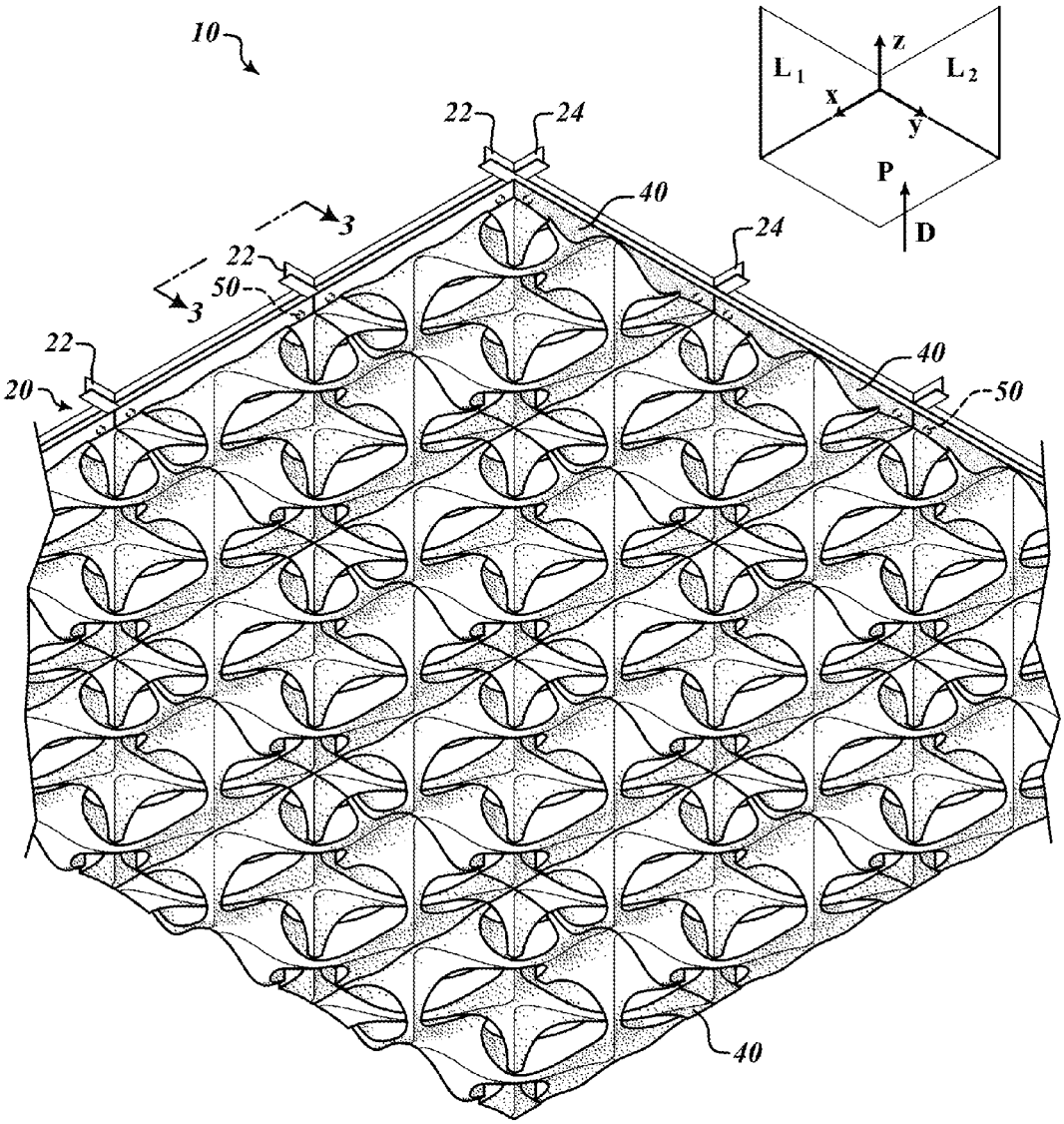
FIG. 1 is an isometric view of a ceiling structure, according to one embodiment.
Figure 2:
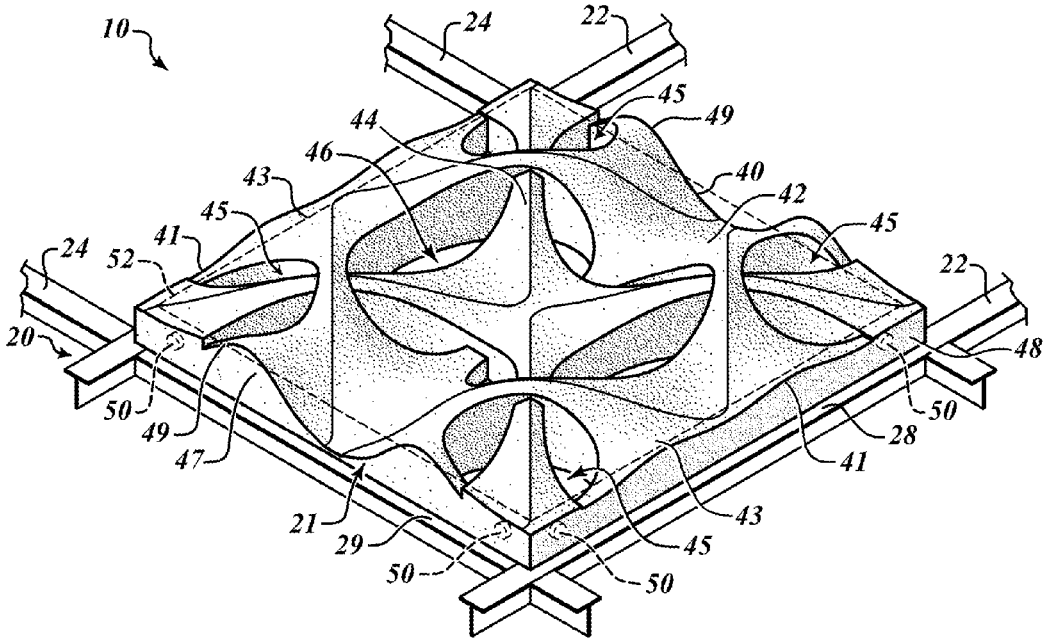
FIG. 2 is a partial detail view of the ceiling structure of FIG. 1, with the ceiling structure being inverted and certain components removed for clarity.
Figure 3:
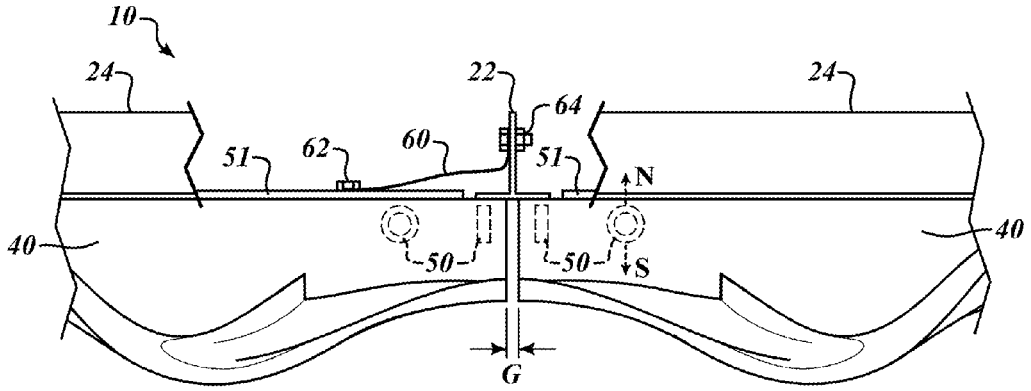
FIG. 3 is a partial elevational side view of the ceiling structure of FIG. 1 in a direction along line 3-3.

FIGS. 1-3 illustrate a ceiling structure 10 according to one embodiment. The ceiling structure 10 includes a suspended framework 20 and a plurality of ceiling tiles 40 that are coupled to the suspended framework 20. The suspended framework 20 is generally suspended from an overhead structure (not shown) by hanging wires, braces or other structures that couple the suspended framework 20 to the overhead structure. The suspended framework 20 includes a plurality of main runners 22 that are spatially spaced apart and are substantially parallel to each other. The suspended framework 20 further includes a plurality of cross runners 24 that are spatially spaced apart and are substantially parallel to each other, but are oriented to be substantially perpendicular to the plurality of main runners 22. The main runners 22 and the cross runners 24 may be manufactured from extrusions having various cross-sectional profiles. For example, as illustrated in FIG. 1, the main runners 22 and the cross runners 24 have a generally T-shaped cross section. In alternate embodiments, however, the main runners 22 and cross runners 24 may have an L-shaped cross section, a C-shaped cross section, or other shapes and configurations.

The cross runners 24 are coupled to the main runners 22 in a known manner. The coupling of the cross runners 24 to the main runners 22 defines tile receiving openings 21. The area of each of the tile receiving openings 21 (i.e., width and length) depends on the spacing of the main runners 22 and the cross runners 24. This spacing can be adjustable based on the areas of the ceiling tiles 40 that are to be positioned within the tile receiving openings 21, such that the ceiling tiles 40 substantially cover or overlay the tile receiving openings 21. Each tile receiving opening 21 also defines a mounting frame 28 that bounds the tile receiving opening 21 and includes mating surfaces 29 that generally face downward, i.e., facing a floor structure of an interior of a room or space. The mating surfaces 29 may be defined by base flanges of the main runners 22 and the cross runners 24, to which the ceiling tiles 40 are coupled to, as discussed in more detail elsewhere.

As best seen in FIG. 2, an exterior of the ceiling tile 40 of the example embodiment includes distinct three-dimensional surface regions. In the embodiment shown, the exterior of the ceiling tile 40 includes a central surface region 42, two side surface regions 43, which are a mirror image of each other, and a main surface region 44. The ceiling tile 40 further includes windows 45 or voids proximate to the corners of the ceiling tile 40 and a window 46, which is generally positioned at the center of the ceiling tile 40. The windows 45, 46 advantageously provide access to opposing sides of the tiles 40. Further, the windows 45, 46 also allow passage of light therethrough. While the embodiment shown in FIGS. 1-3 includes surface regions 42, 43, and 44, any number of distinct three-dimensional surface regions may be included. Additionally, the ceiling tiles 40 may include any number of windows or voids which extend entirely through a thickness of the tiles 40 to provide access to opposing sides thereof. In some embodiments, the windows 45, 46 may also be covered with a translucent diffusion material to collect and diffuse light from skylights or other illuminated fixtures above the suspended framework 20.

With continued reference to FIGS. 1-3, the three-dimensional surface regions are bounded by opposing first side surfaces 47 and opposing second side surfaces 48, which form a perimeter around the ceiling tile 40. Each of the first side surfaces 47 and the second side surfaces 48 includes a complex curve or shape at an exterior edge 41, 49 thereof. The curve or shape of the exterior edges 41, 49 may be curvilinear, rectilinear, continuous, disjointed, or of other forms. Extending inwardly from the side surfaces 47, 48, the ceiling tile 40 includes a peripheral portion 52, which is illustrated by phantom lines in FIG. 2. As illustrated in FIG. 2, the peripheral portion 52 is relatively thin-walled and includes four legs that are positioned at a periphery of the ceiling tile 40, thereby forming a boundary of the ceiling tile 40. A plurality of magnets 50 are embedded within the ceiling tile 40 and are positioned at or within the peripheral portion 52. Although in the illustrated embodiment of FIGS. 1-3, the magnets 50 are embedded within the ceiling tile 40, in alternate embodiments, the ceiling tile 40 may have apertures, recesses, or the like to receive and/or couple the magnets 50 to the ceiling tile 40.

In the illustrated embodiment of FIGS. 1-3, two magnets 50 are positioned at each leg of the peripheral portion 52, with each magnet 50 being positioned at a respective opposing end of the leg. The magnets 50 are advantageously selected to produce sufficient magnetic force so as to couple the ceiling tile 40 to the mating surfaces 29 of the respective mounting frame 28, where the main runners 22 and the cross runners 24 are generally made from steel or other ferromagnetic materials. In the illustrated embodiment of FIGS. 1-3, the magnets 50 are radial magnets and are diametrically magnetized with the corresponding polarity shown in FIG. 3. In this manner, the magnets 50 produce a magnetic force in a direction that is substantially normal to the mating surfaces 29 so as to attract the ceiling tile 40 to the suspended framework 20. While the example embodiment includes radial magnets, in alternative embodiments, a bar magnet, a sphere magnet, or other magnets may be used instead. Further, as best seen in FIG. 3, the magnets 50 are annular, having an aperture or cavity extending therethrough. As the magnets 50 are embedded within the ceiling tile 40, such cavities include and are surrounded by the ceiling tile 40 material, so as to advantageously allow for sufficient ceiling tile 40 material between the magnets 50 and the ceiling tile 40. In this manner, cracking or other forms of damage of the ceiling tile 40 material surrounding the magnets 50 may be prevented when the magnets 50 produce excessive magnetic force.

While in the illustrated embodiment of FIGS. 1-3, two magnets 50 are positioned at each leg of the peripheral portion 52, with each magnet 50 being positioned at a respective opposing end of the leg, in alternate embodiments, any number of magnets may be selected to provide sufficient coupling magnetic force. Moreover, in alternate embodiments, each leg of the peripheral portion 52 may include a combination of diametrically magnetized magnets to couple to the mating surfaces 29 and axially magnetized magnets to couple to corresponding axially magnetized magnets of adjacent ceiling tiles, where the axially magnetized magnets are configured to have the appropriate polarities so as to attract the adjacent ceiling tiles to one another.

FIG. 3 illustrates an elevational side view of the ceiling structure 10 in a direction along line 3-3. As illustrated in FIG. 3, an alignment portion 51 extends upwardly from a back side of the ceiling tile 40. The alignment portion 51 may be formed integrally with the tile or may be a separate structure or structures coupled to a main body of the ceiling tile 40. The alignment portion 51 is shaped to align with the tile receiving opening 21, in order to assist in the assembly of the ceiling tiles 40 to the ceiling structure 10 by centering the ceiling tile 40 within the tile receiving opening 21. For example, the alignment portion 51 may have an area (i.e., width and length) that is slightly less than the area of the tile receiving opening 21. In this manner, as the alignment portion 51 will be enclosed by the tile receiving opening 21, the ceiling tiles 40 can be substantially centered and provide an appearance of a generally continuous ceiling structure 10.

Although in the illustrated embodiment of FIGS. 1-3 the alignment portion 51 is a unitary raised portion, in alternate embodiments the ceiling tile 40 may include any number of individual raised structures positioned at a perimeter of edges of the tile receiving openings 21 along which the ceiling tile 40 is to be aligned so as to center the ceiling tile 40 within the tile receiving opening 21. Providing for such individual raised structures may advantageously reduce the weight of each of the individual ceiling tiles 40 and thus the weight of the overall ceiling structure 10.

With reference to FIG. 3, a safety lanyard 60 may be provided to properly secure the ceiling tile 40 to the ceiling structure 10. One end of the safety lanyard 60 may be coupled to the alignment portion 51 or other structure of the ceiling tile 40 with a fastener 62 and the other end of the lanyard 60 may be coupled to an upstanding flange or other portion of the main runner 22 or cross runner 24 with a second fastener 64, thus providing additional structural robustness to the overall ceiling structure 10. In alternate embodiments, however, safety lanyards 60 may be provided at either side of the main runner 22 or cross runner 24, or the safety lanyard 60 may be coupled between the ceiling tile 40 and the overhead structure, rather than the suspended framework 20. Further, in some embodiments, the safety lanyard 60 may be coupled between the adjacent ceiling tiles 40 only.

With reference to FIGS. 1 through 3, the ceiling tiles 40 may be arranged in a manner such that each ceiling tile 40 has a relatively small gap G between adjacent ceiling tiles. The gap G may vary between 0.01 inch to 0.1 inch, such that when the ceiling structure 10 is viewed from below, an exterior contour of the ceiling structure 10 appears substantially continuous. Moreover, each of the ceiling tiles 40 may be arranged in a manner so that the first and second side surfaces 47, 48 and their respective exterior edges 49, 41 are positioned adjacent to corresponding first and second side surfaces 47, 48 and edges 49, 41 of the adjacent ceiling tiles 40 with relatively small gaps therebetween. Such an arrangement advantageously presents a continuous exterior contour view of the ceiling structure 10. The exterior contour of the ceiling structure 10 may present a distinct three-dimensional pattern that is symmetric about a longitudinal mid-plane $L_1$ and a lateral mid-plane $L_2$, as shown in FIG. 1.

Figure 4:
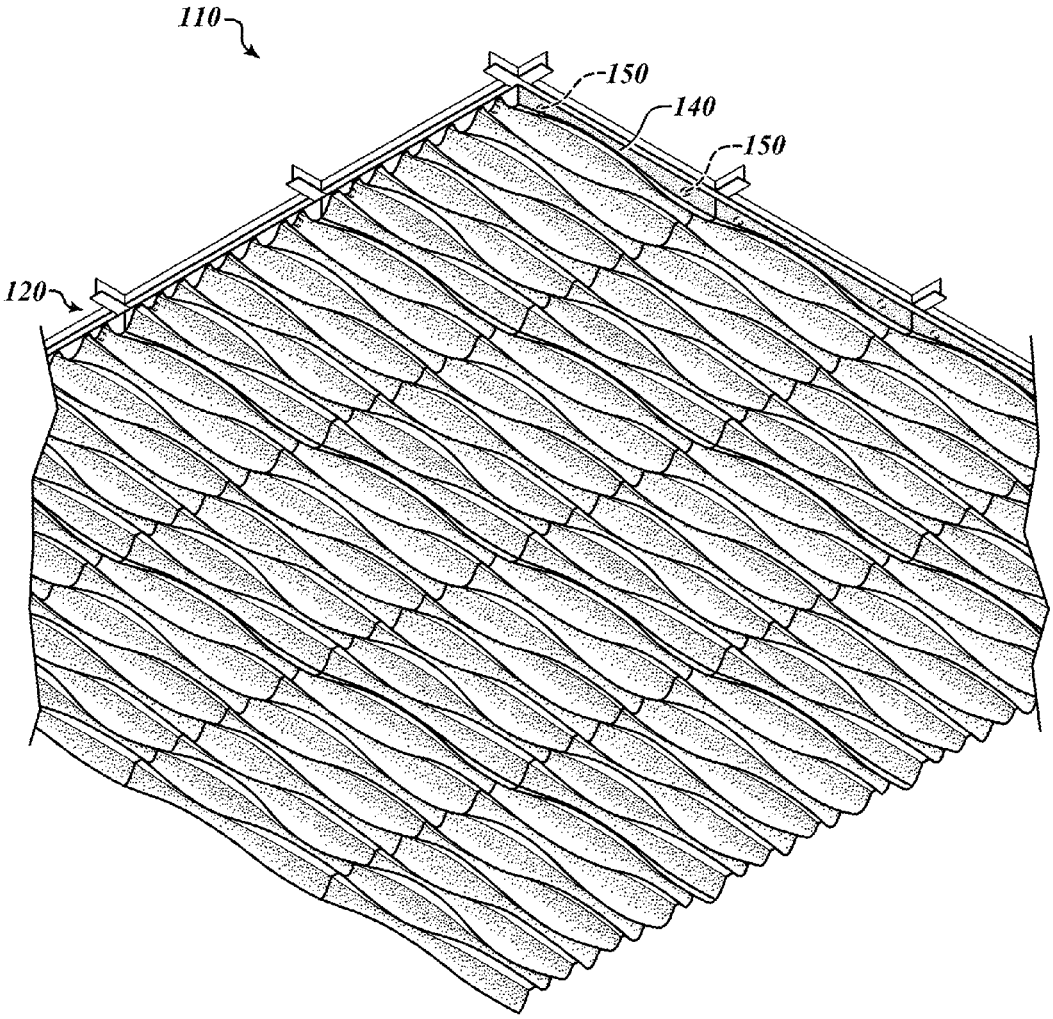
FIG. 4 is an isometric view of a ceiling structure, according to another embodiment.
Figure 5:
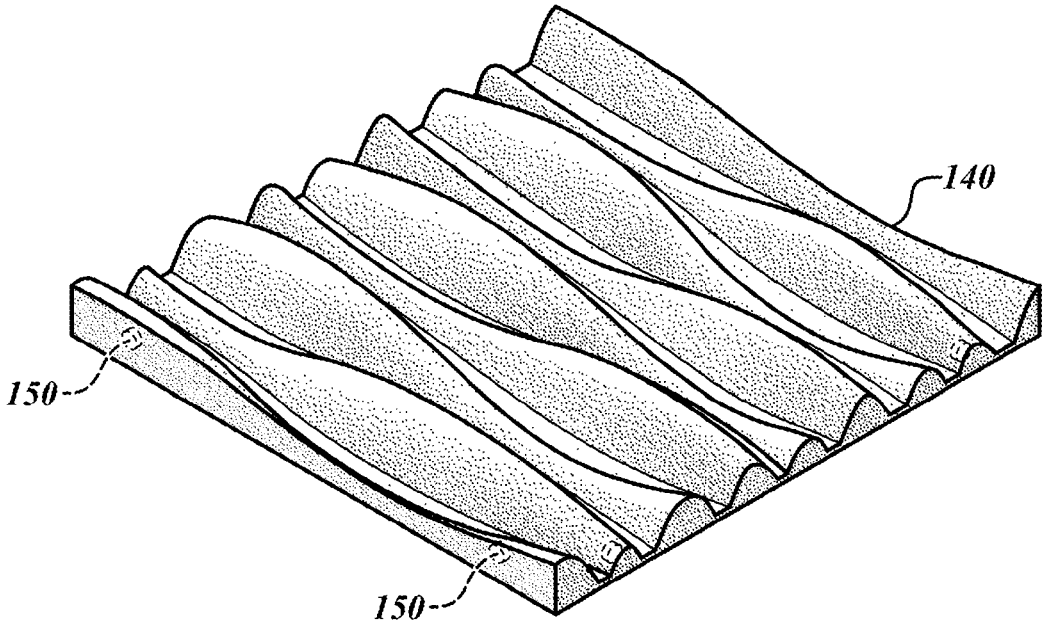
FIG. 5 is a detail view of a ceiling tile of FIG. 4 and inverted for clarity.

FIGS. 4 and 5 illustrate another embodiment of a ceiling structure 110, having a plurality of ceiling tiles 140 coupled to a suspended framework 120. This ceiling structure 110 illustrates a variation in which each of the ceiling tiles 140 includes a plurality of compound curved surfaces that include a number of ridges and valleys or "waves" as they extend from end to end. The ceiling tiles 140 may be coupled to the suspended framework 120 in a similar manner as described above, i.e., through magnets 150, so as to provide a continuous exterior contour that substantially conceals the framework 120 to which it is attached.

Figure 6:
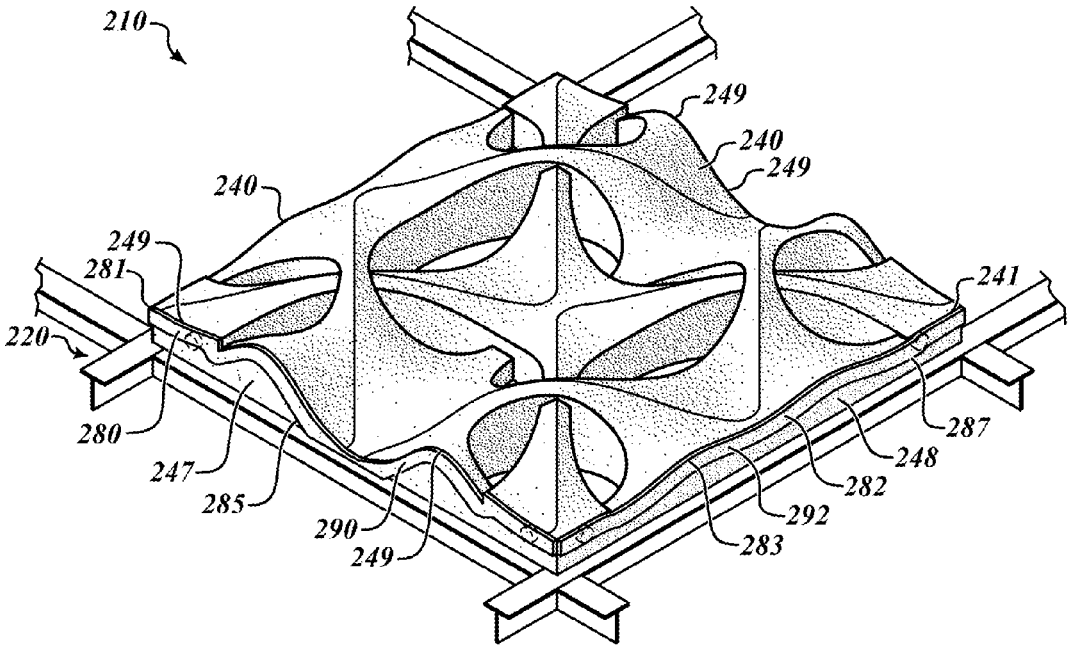
FIG. 6 is a partial detail view of a ceiling structure, according to another embodiment, with the ceiling structure being inverted and certain components thereof removed for clarity.
Figure 7:
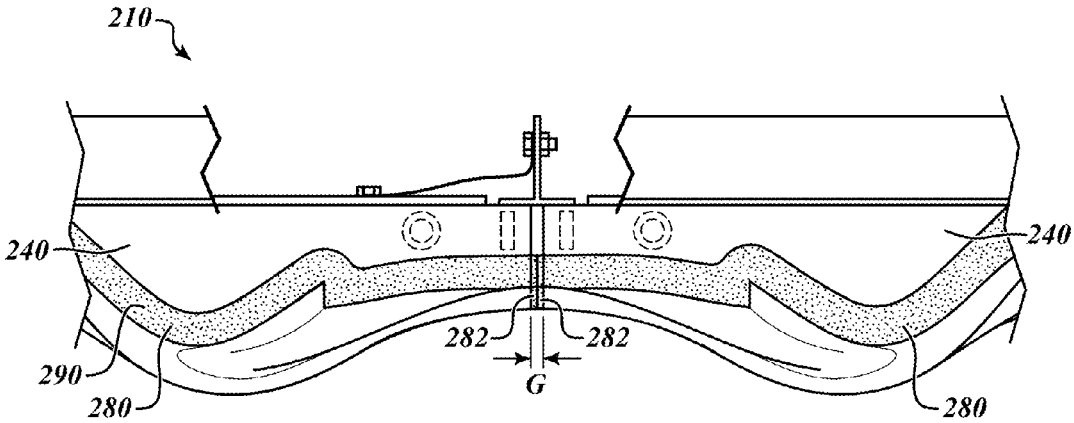
FIG. 7 is a partial elevational side view of the ceiling structure of FIG. 6.

FIGS. 6 and 7 illustrate another embodiment of a ceiling structure 210. The ceiling structure 210 includes a suspended framework 220 and a plurality of ceiling tiles 240 that are coupled to the suspended framework 220. The ceiling structure 210 provides a variation in which the ceiling structure 210 includes a pair of opposing first gaskets 280 and a pair of opposing second gaskets 282 secured to respective first and second surfaces 247, 248 of the ceiling tiles 240. The first and second gaskets 280, 282 are secured to the ceiling tiles 240 to form a perimeter around the ceiling tiles 240. Each of the first and second gaskets 280, 282 include a complex curve or shape at an exterior edge 281, 283 thereof. The curve or shape of the exterior edges 281, 283 are advantageously configured to substantially match the curve or shape of an exterior edge 249, 241 of the respective first and second side surfaces 247, 248 of the ceiling tiles 240.

Each of the first and second gaskets 280, 282 also include an interior edge 285, 287. In the embodiment illustrated in FIGS. 6 and 7, the interior edges 285, 287 are substantially parallel to the exterior edges 281, 283 of the first and second gaskets 280, 282. However, in some embodiments, the interior edges 285, 287 of the first and second gaskets 280, 282 may have other curves or shapes. For example, in some embodiments, the interior edges 285, 287 may have a linear shape, such that the interior edges 285, 287 are substantially parallel to interior edges of the first and second side surfaces 247, 248. Further, in some embodiments, the ceiling structure 210 may include a unitary or a one-piece gasket. The gasket may be configured to form a perimeter bounding the first and second surfaces 247, 248 of the ceiling tile 240.

The first and second gaskets 280, 282 are configured in a manner such that, when the first and second gaskets 280, 282 are secured to ceiling tiles 240, exterior surfaces 290, 292 of the first and second gaskets 280, 282 abut or make substantial contact with exterior surfaces 290, 292 of first and second gaskets 280, 282 secured to adjacent ceiling tiles 240. By way of example, FIG. 7 illustrates the ceiling tiles 240 being arranged such that the exterior surfaces 292 of the second gaskets 282 abut or make substantial contact with one another. More particularly, the first and second gaskets 280, 282 are configured to be positioned within the gap G between adjacent ceiling tiles 240. Positioning the first and second gaskets 280, 282 in this manner advantageously presents a continuous exterior contour view of the ceiling structure 210.

The first and second gaskets 280, 282 may comprise metallic or non-metallic materials. For example, in some embodiments, the first and second gaskets may comprise rubber or a polymer, such as an elastomer, for example. In general, the first and second gaskets 280, 282 are selected to have suitable moldability and compressibility properties. Thus, the first and second gaskets 280, 282 can be fabricated to substantially match the complex curves or shapes of the ceiling tiles and have suitable compressibility properties to substantially fill the gap G between adjacent ceiling tiles 240. The first and second gaskets 280, 282 can be secured to the ceiling tiles 240 via adhering, fastening, or other suitable means.

Figure 8:
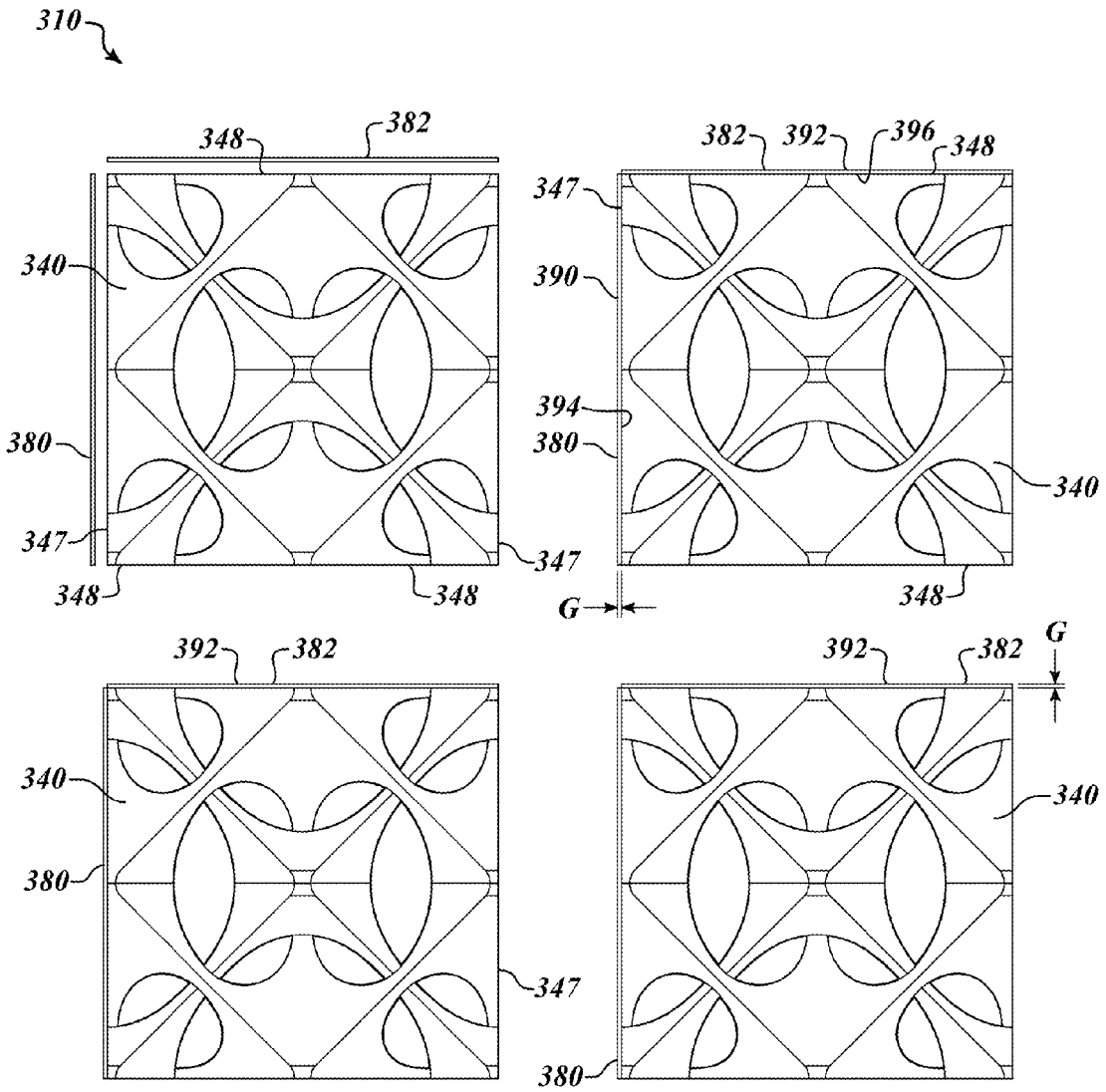
FIG. 8 is a partially exploded top plan view of a ceiling structure, according to another embodiment, with certain components removed for clarity.

FIG. 8 is a partially exploded top plan view of another embodiment of a ceiling structure 310, with ceiling tiles 340 being illustrated spaced and adjacent to one another and certain components being removed for clarity. The ceiling structure 310 provides a variation in which the ceiling structure 310 includes a first gasket 380 secured to one of a pair of opposing first surfaces 347 of the ceiling tiles 340 and a second gasket 382 secured to one of a pair of opposing second surfaces 348 of the ceiling tiles 340. The first and second gaskets 380, 382 include exterior surfaces 390, 392 and interior surfaces 394, 396. The first and second gaskets 380, 382 are secured to the ceiling tiles 340 by coupling the interior surfaces 394, 396 of the first and second gaskets 380, 382 to the respective first and second surfaces 347, 348 of the ceiling tiles 340. Again, the first and second gaskets 380, 382 can be secured to the ceiling tiles 340 via adhering, fastening, or other suitable means.

The first and second gaskets 380, 382 are configured in a manner such that, when the first and second gaskets 380, 382 are secured to the ceiling tiles 340, exterior surfaces 390, 392 of the first and second gaskets 380, 382 abut or make substantial contact with the respective first and second surfaces 347, 348 of the adjacent ceiling tiles 340. As illustrated in FIG. 8, the ceiling tiles 340 are arranged such that the exterior surface 392 of the second gasket 382 abuts or makes substantial contact with the second surface 348 of the adjacent ceiling tile 340, which does not include a second gasket 382 secured thereto. In a similar manner, the exterior surface 390 of the first gasket 380 abuts or makes substantial contact with the first surface 347 of the adjacent ceiling tile 340, which does not include a first gasket 380 secured thereto. More particularly, the first and second gaskets 380, 382 are configured such that the first and second gaskets 380, 382 fill the gap G between adjacent ceiling tiles 340. Positioning the first and second gaskets 380, 382 in this manner advantageously presents a continuous exterior contour view of the ceiling structure 310.

Again, while the embodiment of the ceiling structure 310 includes first and second gaskets 380, 382, in other embodiments, the ceiling structure 310 may include a unitary or a one-piece gasket.

The ceiling structure 10 may be assembled by first constructing a suspended framework 20 in a known manner as discussed previously. Based on the number of resulting tile receiving openings 21, corresponding number of ceiling tiles 40 may be provided. Each ceiling tile 40 may be positioned upwardly relative to the floor of the room or space, and then centered by aligning the alignment portion 51. After the ceiling tiles 40 have been centered, the magnetic force produced by the magnets 50 would secure the ceiling tile 40 to the suspended framework 20. Moreover, the ceiling structure 10 can advantageously provide for simple replacement or disassembly. The ceiling tile 40 may be removed by applying a counterforce to overcome the magnetic force of the magnets 50, for example, by simply gripping, clamping, or holding the ceiling tile 40 and pulling it downwardly. Further, removal or disassembly of the ceiling tiles 40 may also be accomplished by using any tool that provides a sufficient hold of the ceiling tile 40 to facilitate applying a sufficient force to overcome the magnetic force of the magnets 50 in order to remove the ceiling tile 40. Where the ceiling tile 40 has to be replaced, a replacement ceiling tile 40 may be installed in the same manner as discussed above.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A ceiling structure comprising:

a suspended framework having a plurality of main runners and a plurality of cross runners interconnected to define an array of tile receiving openings, each of the plurality of main runners and the plurality of cross runners including a tile mating surface facing downward to define a mounting frame at each respective tile receiving opening; and a plurality of ceiling tiles including a bottom surface facing away from the suspended framework and a top surface facing the suspended framework, the bottom surface and the top surface defining a thickness of the ceiling tiles, each of the plurality of ceiling tiles positioned within the array of tile receiving openings, each of the plurality of ceiling tiles having a plurality of magnets positioned at a peripheral portion thereof, the plurality of magnets magnetically coupling the ceiling tile within a respective one of the tile receiving openings with the top surface of the ceiling tile abutting the tile mating surface which defines the respective mounting frame.

2. The ceiling structure of claim 1 wherein each ceiling tile includes at least one alignment structure extending from the top surface of the ceiling tile, the at least one alignment structure shaped to assist in centering the ceiling tile within the tile receiving opening.

3. The ceiling structure of claim 1, further comprising:

at least one lanyard that couples one or more of the ceiling tiles to the suspended framework.

4. The ceiling structure of claim 3 wherein the at least one lanyard includes a first end coupled to the top surface of the ceiling tile and a second end coupled to the suspended framework.

5. The ceiling structure of claim 1 wherein each of the plurality of magnets comprises a radial magnet, the radial magnet oriented within the ceiling tile such that the radial magnet produces a magnetic force in a direction substantially normal to a reference plane defined by the suspended framework.

6. The ceiling structure of claim 1 wherein the plurality of ceiling tiles are arranged within the suspended framework so as to create a relatively small gap between adjacent ones of the ceiling tiles such that an exterior contour of the ceiling structure appears substantially continuous.

7. The ceiling structure of claim 1 wherein the plurality of ceiling tiles are arranged so as to define a three-dimensional pattern, the three-dimensional pattern being symmetric about a first mid-plane and a second mid-plane, each mid-plane being perpendicular to a reference plane defined by the suspended framework.

8. The ceiling structure of claim 1 wherein each of the plurality of ceiling tiles includes side surfaces forming a perimeter around the ceiling tile, each side surface including an exterior edge comprising a complex curve or shape that substantially aligns with a respective complex curve or shape of a corresponding exterior edge of a corresponding side surface of an adjacent ceiling tile such that a three-dimensional contour is maintained across an interface of adjacent ceiling tiles.

9. The ceiling structure of claim 1 wherein the plurality of magnets are embedded in a material of the ceiling tile, the material surrounding and extending through a cavity of each magnet.

10. A system of ceiling tiles attachable to a suspended framework, the suspended framework having a plurality of main runners and a plurality of cross runners interconnected to define an array of tile receiving positions, each of the plurality of main runners and the plurality of cross-runners including a tile mating surface facing downward to define a mounting frame at each respective tile receiving position, the system of ceiling tiles comprising:

a plurality of modular tiles configured to form a generally continuous ceiling structure when arranged at the array of tile receiving positions, each modular tile including:

a main body including a peripheral portion and an external side including a bottom surface facing away from the suspended frame work, the bottom surface including an arrangement of three-dimensional surface regions, the main body including a top surface facing the suspended framework, the top surface and the three-dimensional surface regions of the bottom surface defining a thickness of the ceiling tile that is variable; and a plurality of magnets positioned within the peripheral portion of the main body to produce a magnetic force to couple the modular tile to the suspended framework with the top surface of the modular tile abutting the tile mating surface.

11. The system of ceiling tiles of claim 10 wherein each of the plurality of modular tiles includes an alignment structure extending from the top surface of the modular tile, the alignment structure shaped to assist in centering the modular tile within an opening at the tile receiving position.

12. The system of ceiling tiles of claim 10 wherein each of the plurality of modular tiles includes side surfaces forming a perimeter around the modular tile, each side surface including an exterior edge comprising a complex curve or shape that substantially aligns with a respective complex curve or shape of a corresponding exterior edge of a corresponding side surface of an adjacent modular tile such that a three-dimensional contour is maintained across an interface of adjacent modular tiles.

13. The system of ceiling tiles of claim 10 wherein each of the plurality of magnets comprises a radial magnet, the radial magnet oriented within the modular tile such that the radial magnet produces a magnetic force in a direction substantially normal to the suspended framework.

14. The system of ceiling tiles of claim 10 wherein, for each modular tile, the plurality of magnets are embedded in a material of the modular tile, the material surrounding and extending through a cavity of each magnet.

15. A system of ceiling tiles attachable to a suspended framework, the suspended framework having a plurality of main runners and a plurality of cross runners interconnected to define an array of tile receiving positions, each of the plurality of main runners and the plurality of cross runners including a tile mating surface facing downward to define a mounting frame at each respective tile receiving position, the system of ceiling tiles comprising:

a plurality of ceiling tiles configured to form a generally continuous ceiling structure when arranged at the array of tile receiving positions, each ceiling tile including a main body including an external side having an arrangement of three-dimensional surfaces, a peripheral portion, and including a bottom surface facing away from the suspended framework, the bottom surface including an arrangement of three-dimensional surface regions, a peripheral portion, a top surface facing the suspended framework, the top surface and the three-dimensional surface regions of the bottom surface defining a thickness that is variable, the main body further including side surfaces forming a perimeter around the ceiling tile, each side surface including an exterior edge comprising a complex curve or shape that substantially aligns with a respective complex curve or shape of a corresponding exterior edge of a corresponding side surface of an adjacent ceiling tile such that a three-dimensional contour is maintained across an interface of adjacent ceiling tiles; and a plurality of radial magnets positioned within the peripheral portion of the ceiling tile, the radial magnets being oriented to produce a magnetic force in a direction substantially normal to the suspended framework to couple the ceiling tile to the suspended framework with the top surface of the main body of the ceiling tile abutting the tile mating surface.

16. A method for assembling a ceiling structure, the method comprising:

constructing a suspended framework having a plurality of main runners and a plurality of cross runners interconnected to define an array of tile receiving positions, each of the plurality of main runners and the plurality of cross-runners including a tile mating surface facing downward to define a mounting frame at each respective tile receiving position; and magnetically coupling a plurality of ceiling tiles to the suspended framework with a respective ceiling tile located at each tile receiving position, the plurality of ceiling tiles including a bottom surface facing away from the suspended framework and a top surface facing the suspended framework, the bottom surface and the top surface defining a thickness of the ceiling tiles, the coupling including positioning the plurality of ceiling tiles such that the top surface of the ceiling tiles abuts the tile mating surface defining the respective mounting frame.

17. The method of claim 16, further comprising:

coupling each of the plurality of ceiling tiles to the suspended framework with one or more lanyards.

18. The method of claim 16, further comprising:

coupling each of the plurality of ceiling tiles to a ceiling foundation with one or more lanyards.

19. The method of claim 16, further comprising:

centering each of the plurality of ceiling tiles within a respective opening at each of the tile receiving positions using one or more alignment structures extending from the top surface of each respective ceiling tile.

* * * * *